US010808176B2

(12) United States Patent
Yurchenko

(10) Patent No.: US 10,808,176 B2
(45) Date of Patent: Oct. 20, 2020

(54) METHOD OF DELAYED COKING OF PETROLEUM RESIDUES

(71) Applicant: Westport Trading Europe, Ltd., New York, NY (US)

(72) Inventor: Nikolay Yurchenko, Moscow (RU)

(73) Assignee: Westport Trading Europe, Ltd., New York, NY (US)

( * ) Notice: Subject to any disclaimer, the term of this patent is extended or adjusted under 35 U.S.C. 154(b) by 44 days.

(21) Appl. No.: 16/006,509

(22) Filed: Jun. 12, 2018

(65) Prior Publication Data

US 2019/0375989 A1 Dec. 12, 2019

(51) Int. Cl.
*C10B 23/00* (2006.01)
*C10B 57/04* (2006.01)
*C10B 55/00* (2006.01)

(52) U.S. Cl.
CPC ..... *C10B 23/00* (2013.01); *C10B 55/00* (2013.01); *C10B 57/045* (2013.01)

(58) Field of Classification Search
CPC ..... C10B 23/00; C10B 55/00; C10B 57/045; C10G 9/00
See application file for complete search history.

(56) References Cited

U.S. PATENT DOCUMENTS 3,472,761 A * 10/1969 Cameron ..... C10B 55/00 208/131
4,130,475 A * 12/1978 Cameron ..... C10B 55/00 208/131
5,174,891 A * 12/1992 Becraft ..... C10B 55/02 208/125

(Continued)

FOREIGN PATENT DOCUMENTS

RU 2209826 C1 8/2003
RU 2451711 C1 5/2012
RU 2618820 C1 5/2017

OTHER PUBLICATIONS

GOST 26132-84, Interstate Standard, Petroleum and Pitch Cokes. Microstructure Estimation Method, Jul. 1, 1985.

(Continued)

*Primary Examiner* — Randy Boyer
*Assistant Examiner* — Juan C Valencia
(74) *Attorney, Agent, or Firm* — Fox Rothschild LLP

(57) ABSTRACT

The delayed coking method includes directing a heated secondary feedstock, which contains heated primary feedstock and recirculate, from a reaction furnace to a coking chamber. Vapor-liquid coking products formed in the coking chamber are then directed to a fractionation column, which fractionates hydrocarbon gas, gasoline, light and heavy gas oils, and bottom residues. Heavy gas oil from the fractionation column is directed to a thermal cracking furnace, the products of which are cooled by cooled light gas oil and directed to an evaporator for separation. In the evaporator, gases and light boiling products are removed by evaporation and returned to the fractionation column, and the remaining distillate cracking residue is separated and used as a component of the recirculate, along with bottom residues from the fractionation column. The resulting process produces high quality and high yield needle and anode cokes.

15 Claims, 1 Drawing Sheet

(56) References Cited

U.S. PATENT DOCUMENTS

| | | | | |
|---|---|---|---|---|
| 5,645,712 | A * | 7/1997 | Roth | C10B 55/00 208/131 |
| 7,371,317 | B2 | 5/2008 | Newman et al. | |
| 2010/0270208 | A1 * | 10/2010 | Ward | B01D 3/143 208/97 |

OTHER PUBLICATIONS

Kretinin et al., Design of Delayed Coking Plants (Ufa, 1982), p. 70.

* cited by examiner

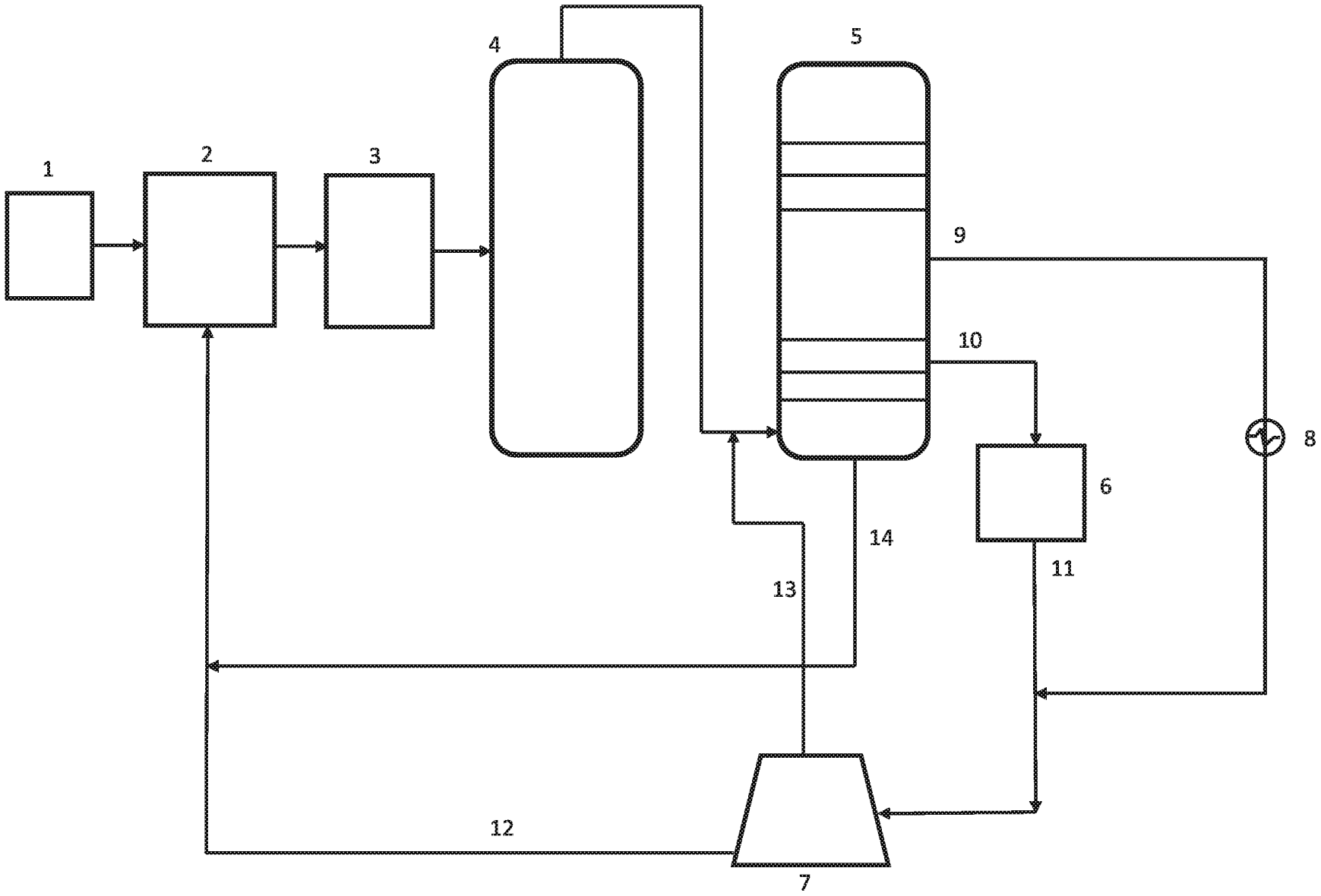
1
2
3
4
5
6
7
8
9
10
11
12
13
14

METHOD OF DELAYED COKING OF PETROLEUM RESIDUES

FIELD

The present disclosure relates to the field of oil refining and delayed coking methods for producing high-quality anode (ordinary) and electrode (needle) cokes.

BACKGROUND

Coking processes have been practiced for many years and are an important source of revenue for many refineries. In a coking process, heavy hydrocarbon feedstock is thermally decomposed, or cracked, into coke and lighter hydrocarbon products. One type of coking process is delayed coking, which generally involves a continuous or semi-continuous process in which heavy hydrocarbon feedstock is heated to cracking temperature using a heat source such as a furnace. The heated feedstock is then fed continuously to a coking drum or coking chamber, where it reacts in its contained heat to convert the feedstock to coke and cracked vapors. The cracked vapors are fed into the bottom of a fractionator, condensed and recovered as lower boiling hydrocarbon products.

Depending upon system design, operating parameters and feedstock, delayed coking is capable of producing a range of coke grades having different physical properties. A high quality grade of coke, needle coke, is a primary feed in production of electrodes. An intermediate quality grade of coke, anode coke, is used primarily for the production of anodes employed in aluminum manufacture. Needle coke and anode coke have generally higher economic value than fuel coke, which is used primarily to fuel power stations and cement kilns. Traditional feedstock materials for use in delayed coking processes include heavy oil residues from primary oil processing (tar), residues from the production of oils (asphalts, residual extracts), and heavy residues of catalytic processes (cracking residues, heavy catalytic cracking oils, heavy pyrolysis resins).

There are two general prerequisites for obtaining commercially valuable high-quality petroleum cokes, both anode and needle, for use in aluminum and electrode industries: qualified selection and preparation of the coking feedstock, and determination of the parameters and conditions of the coking process technology.

Patent RU No. 2209826 discloses a method for delayed coking of petroleum residues that includes heating of the feedstock, mixing the heated feedstock in an evaporator tank with recirculate to form a secondary feedstock, heating the secondary feedstock in a reaction furnace and directing the heated secondary feedstock into a coking chamber where it is coked to form petroleum coke and vapor-liquid coking products, the latter of which are directed to a fractionation column in order to produce gas, gasoline, light and heavy gas oils, and a bottom coking residue. The bottom coking residue is recirculated directly to the evaporator tank where it mixes with the initial heated feedstock. A disadvantage of this method is the resulting low yield of petroleum coke, especially when coking low-sulfur oil residues, and the inconsistent quality of the coke thus produced.

Patent RU No. 2618820 discloses a method for delayed coking of oil residues to produce needle coke. The method includes using a secondary feedstock that contains a mixture of primary feedstock consisting of a mixture of heavy gas oil of catalytic cracking and a extract in the production of oils, in an amount of 20-30% by weight of the primary feedstock, as well as light or heavy gas oils as recirculate. In this method, the ratio of recirculation (the ratio of the amount of secondary feedstock to the amount of primary feedstock) is 1.5 to 2.0. The resulting recirculate-containing secondary feedstock is heated in furnace up to the coking temperature and then fed to the coking chambers where needle coke is formed. The coker distillate from the top of the coking chamber is sent to the bottom of a fractionation column for fractionation. A drawback of this method is the low yield and insufficient quality of the resulting needle coke due to its relatively low estimation of the microstructure. Further, this method aims to increase the yield of coke and improve coke structure by using a very high recycling ratio. However, at times, when the proportion of feed with a low coking ability (e.g., extracts) exceeds a certain value, even a high recycling ratio does not provide a high yield and quality of needle coke. In the process of Patent RU No. 2618820, the maximum yield of coke is only 19.4%.

Patent RU No. 2451711 discloses another method for delayed coking of oil residues that includes heating a primary feedstock and then mixing the heated primary feedstock in an evaporator with heavy gas oil as a recirculate to form a secondary feedstock; heating the secondary feedstock in a reaction furnace and then feeding the heated secondary feedstock into a coking chamber where coke and coking vapor-liquid products are formed, the latter of which are directed to a fractionation column and separated into gas, gasoline, light and heavy gas oils, and residual coke bottoms. The heavy gas oil is subjected to thermal cracking, after which the resulting mixture is mixed with the secondary feedstock before being fed into the coking chamber.

The delayed coking method of Patent RU No. 2451711 is unsatisfactorily limited at least in terms of the quality and yield of the coke produced. One particular disadvantage of such a method is that all of the gaseous and light-boiling products formed during the thermal cracking process—i.e., gas, gasoline, light gas oil, and distillate cracking residue—are fed into the coking chamber. Gaseous and light-boiling products are ballast in the coking mass and increase the linear vapor velocities in the coking chamber beyond the permissible maximum of 0.09-0.15 m/s. See Kretinin, et al., DESIGN OF DELAYED COKING PLANTS (Ufa, 1982) p. 70. High linear vapor velocities (particularly in excess of permissible values) lead to increased foaming in the coking chamber, which reduces the density of coking mass in the coking chamber and, in turn, reduces the mechanical strength of the resulting coke. Additionally, high linear vapor velocities and the transfer and introduction of foam into downstream process equipment prevent the full volume of the coking chambers from being optimally used. One way to prevent the transfer of coke foam from the coking chamber into the fractionation column is to limit the height to which the chamber fills with coke, but this is an undesirable solution as it necessarily decreases the feed capacity of the coking unit in terms of feedstock.

Accordingly, there is a need for an improved delayed coking process that increases both the quality and yield of coke produced.

SUMMARY

The present disclosure relates generally to delayed coking methods for producing high-quality anode and electrode (needle) cokes.

In one aspect, the disclosed technology relates to a method for delayed coking of petroleum residues, including: (a) mixing a primary feedstock and a recirculate in a vessel to form a secondary feedstock; (b) heating the secondary feedstock in a furnace; (c) directing the heated secondary feedstock to a coking chamber to form coke and vapor-liquid coking products; (d) fractionating the vapor-liquid coking products in a fractionation column to produce gas, gasoline, light and heavy gas oils, and bottom residue; (e) thermally cracking the fraction of heavy gas oil to produce gas, gasoline, light gas oil, and distillate cracking residue; (f) evaporating the gas, gasoline, and light gas oil from the distillate cracking residue; and (g) and directing the separated distillate cracking residue to the vessel as a component of the recirculate.

In one embodiment, the method further includes directing the fraction of bottom residue from the fractionation column to the vessel as a component of the recirculate. In another embodiment, the method further includes cooling a portion of the fraction of light gas oil from the fractionation column and mixing the cooled light gas oil with the gas, gasoline, remaining light gas oil, and distillate cracking residue of step (e) before evaporating in step (f). In another embodiment, the gases and light boiling products separated from the distillate cracking residue in step (f) are directed to the fractionation column. In another embodiment, the gases and light boiling products are mixed with the vapor-liquid coking products before entering the fractionation column. In another embodiment, the coke is needle coke or anode coke.

In another embodiment, the primary feedstock includes vacuum distillation residues (tar) of low sulfur oils, heavy gas oil of catalytic cracking, or a mixture of heavy gas oil of catalytic cracking and furfural extract in the production of oils. In another embodiment, the mixture of heavy gas oil of catalytic cracking and furfural extract in the production of oils is in a ratio of about 70:30. In another embodiment, the secondary feedstock is heated to a temperature of about 470° C. to about 510° C. In another embodiment, the temperature in the bottom portion of the fractionation column is about 380° C. to about 390° C. In another embodiment, thermal cracking of step (e) is conducted at a temperature of about 490° C. to about 530° C. In another embodiment, the evaporating of step (f) is conducted at a temperature of about 400° C. to about 420° C. In another embodiment, the coke is needle coke, with a recirculation ratio of the amount of secondary feedstock to the amount of primary feedstock being in the range of about 1.5:1 to about 2:1. In another embodiment, the coke is anode coke and the recirculation ratio of the amount of secondary feedstock to the amount of primary feedstock is in the range of about 1:1 to about 2:1.

BRIEF DESCRIPTION OF THE DRAWINGS

The drawing provided herewith illustrates particular embodiments of the present disclosure and do not limit the scope of the present disclosure. The drawings are not to scale and are intended for use in conjunction with the explanations in the following detailed description.

FIG. 1 is a schematic of aspects of an example of a delayed coking process according to the present disclosure.

DETAILED DESCRIPTION

The disclosed delayed coking process increases both the quality and yield of coke produced by substantially enhancing the quality of the recirculate and increasing the productivity of the coking chamber. In particular, the disclosed process limits foaming in the coking chamber by reducing the linear vapor velocities therein. Reference to various embodiments or examples of the disclosure does not limit the scope of the claims attached hereto. Any examples set forth in this specification are not intended to be limiting and merely set forth some of the many possible embodiments for the appended claims.

FIG. 1 depicts an example of a delayed coking process according to the present disclosure. As shown, a primary feedstock is provided in a tank (e.g., furnace, vessel, heat-exchanger system, etc.) 1 where the feedstock is heated. The heated primary feedstock is then directed to a secondary feed tank 2 where the primary feedstock is mixed with recirculate (described in further detail below) to form a secondary feedstock. The secondary feedstock is then directed to a reaction furnace 3 where the secondary feedstock is heated to the coking temperature and fed into the coking chamber 4 to produce coke and vapor-liquid coking products.

Vapor-liquid coking products formed in the coking chamber 4 exit through the top of the coking chamber 4 and are directed to the bottom of the fractionation column 5. In the fractionation column 5, the vapor-liquid coking products are fractionated into hydrocarbon gas, gasoline, light and heavy gas oils, and bottom residues. A fraction of heavy gas oil exits fractionation column 5 through line 10 and into a thermal cracking furnace 6, which produces hydrocarbon gas, gasoline, light gas oil, and distillate cracking residue. These products of thermal cracking of heavy gas oil exit thermal cracking furnace 6 through line 11, which leads into the evaporator 7. A cooled fraction of light gas oil exits the fractionation column 5 through line 9, which may include an in-line heat exchanger 8, and into line 11 so as to cool the products of heavy gas oil thermal cracking before entering the evaporator 7.

In the evaporator 7, cooled products of thermal cracking of heavy gas oil are subject to evaporation, after which the gases and light boiling products are removed through line 13 and returned to the bottom of the fractionation column 5 along with the vapor-liquid coking products from the coking chamber. Remaining distillate cracking residue in the evaporator 7 is directed through line 12 to the secondary feed tank 2. This distillate cracking residue is a component of the recirculate that mixes with the heated primary feedstock in secondary feed tank 2. Another component of the recirculate includes bottom residues that are directed from the bottom of the fractionation column 5 through line 14, which likewise leads to the secondary feed tank 2.

The secondary feedstock thus includes primary feedstock and recirculate, wherein the recirculate includes distillate cracking residue (from the evaporator) and bottom residues (i.e., bottom gas oil that is the most heavily boiling fraction from the fractionation column). In the disclosed method, an evaporator removes gases and light boiling products from the products of thermal cracking of heavy gas oil. Accordingly, the recirculate contains little to no gases and light boiling products, which provides significant advantages over prior delayed coking methods. Evaporating (distilling) the light boiling products results in the formation of a heavy distillate cracking residue that is directed to the secondary feed tank as a recirculate. Because light boiling products are absent from the heavy distillate cracking residue, such light boiling products do not enter the coking chamber. Consequently, coke yield increases, vapor velocities decrease, and coke structure improves in accordance with the disclosed method.

The high quality of the secondary feedstock in the disclosed process provides for an increase in the yield of particularly valuable anode and needle cokes, improves energy efficiency, and enhances the structural organization of the coke. Further, the disclosed process does not rely on a high recycling ratio to achieve these excellent results. For example, the disclosed process can produce needle coke yields of about 22% to about 31%, including about 24% to about 29%. When producing needle coke, the ratio of recirculation, i.e. the ratio of the amount of secondary feedstock to the amount of primary feedstock, may be about 1.5:1 to about 2:1, such as about 1.8:1. When producing ordinary (anode) coke, the ratio of recirculation, i.e. the ratio of the amount of secondary feedstock to the amount of primary feedstock may be about 1:1 to about 2:1, such as about 1.3:1 or about 1.5:1, depending on the requirements for the content of volatile substances. In general, if a larger coke yield is needed, the recycling ratio can be increased for either needle or anode coke production.

Further, in the disclosed process, gaseous and light-boiling fractions of the products of thermal cracking of coking do not enter the coking chamber. As a result, the linear velocity of vapors in the upper part of the coking chamber of the disclosed process decreases and, consequently, foaming decreases, which prevents the detrimental transfer of coke particles with steam-liquid coking products. Reducing both linear vapor velocities and foaming provide an increase in the density of the coking mass in the coking chamber, which increases the mechanical strength of the resulting coke. Less foaming in the coking chamber provides for a lower foam layer above the coke level, which not only decreases the content of coke particles in the bottom residue, but also makes it possible to fill the chamber with coke to a higher level. Accordingly, a larger amount of the initial (primary) feed can be processed more efficiently and with an increase in the production of coke.

To produce coke of a needle-type microstructure, the primary feedstock of the disclosed process can include heavy gas oil of catalytic cracking containing a sufficiently large number of polycyclic aromatic hydrocarbons and a small amount of asphaltenes, or a mixture of heavy gas oil of catalytic cracking with a furfural extract in the production of oils. In one example, the ratio of heavy gas oil of catalytic cracking to furfural extract in the production of oils can be about 70:30. To produce anode (ordinary) coke, the primary feedstock of the disclosed process can include vacuum distillation residues (tar) of low sulfur oils. The primary feedstock can be heated in a primary feed tank, such as a furnace, or by using a heat exchanger or other heating mechanism.

The primary feedstock is fed into a secondary feed tank where it is mixed with recirculate to form a secondary feedstock. The mixed secondary feedstock can be withdrawn from the bottom of the secondary feed tank and directed into a reaction furnace wherein it is heated to the coking temperature (within a range of about 465° C. to about 515° C., such as about 470° C. to about 510° C., or about 480° C. to about 500° C.) and then sent to one or more coking chambers.

The process can include more than one coking chamber in a variety of arrangements. For example, when the contents of a first coking chamber reach a predetermined level, the supply of heated secondary feedstock can be switched to a second coking chamber, which likewise directs vapor-liquid coking products to the bottom of the fractionation column. The first coking chamber can then be steamed, cooled and de-coked (e.g., using a hydraulic cutter), and then used again after the contents of the second coking chamber reach a predetermined level. Alternatively, the secondary feedstock can be directed to more than one coking chamber, each of which directs vapor-liquid coking products to a fractionation column. In any case, the disclosed process may be run continuously in terms of supplying feed to coking chambers, with periodic unloading of coke. The coking chamber operates at a coking temperature of about 470° C. to about 510° C. for delayed coking of the secondary feedstock.

The resulting coking distillate is directed from the coking chamber through overhead pipes (i.e., from the top of the coking chamber) to the lower part of the fractionation column to produce fractions of hydrocarbon gas, gasoline, light and heavy gas oils and bottom residues.

The fractionation column separates vapor-liquid coking products from the coking chamber as well as gaseous and light boiling products of thermal cracking that are separated and collected from the evaporator. The temperature at the bottom of the fractionation column may be about 380° C. to about 390° C. The fraction of heavy gas oil is removed from the accumulator (blind plate) of the fractionation column and fed to the furnace for thermal cracking. The fractionation column may be operated with circulating reflux (or pump-around) wherein certain petroleum products are removed from the fractionation column, cooled, and then returned to the fractionation column again. This may be done for various reasons—e.g., to regulate the fractional composition of the light or heavy gas oils, to regulate the temperature at the bottom of the column, and/or to regulate the fractional composition of the bottom gas oil.

The temperature of the thermal cracking furnace may be about 490° C. to about 530° C. The obtained cracking products (gas, gasoline, light gas oil and distillate cracking residue) are cooled at the outlet of the thermal cracking furnace using a feed of cooled light gas oil. The cooled light gas oil is a fraction supplied from the fractionation column and fed through a heat exchanger at a temperature of about 80° C. to about 100° C., such as about 90° C. In general, the amount and the temperature of the cooled light gas oil is selected so as to maintain the temperature of the products of thermal cracking at about 400° C. to about 420° C. at the inlet of the evaporator, and thus prevent coking inside the evaporator. If desired, excess light gas oil may be removed from the process and collected for use as a commercial product.

The cooled thermal cracking products are then fed to the evaporator, which is operated at a temperature of about 400° C. to about 420° C. The gaseous and light boiling cracked products exit the top of the evaporator and are directed together with the coking distillate (vapor-liquid coking products) from the coking chamber to the fractionation column for fractionation. The distillate cracked residue from the evaporator and bottom residue from the fractionation column form a mixture that is fed to the bottom of the secondary feed tank for mixing with the primary feedstock and formation of a secondary feedstock that is then heated in a reaction furnace.

Throughout the process, the pressure of the various containers is maintained at about 0.35 MPa to about 0.4 MPa.

EXAMPLES

The present invention is next described by means of the following examples. The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Examples 1-3 (Disclosed Inventive Process) and Examples 4-6 (Comparative Process)

In Examples 1-3, delayed coking of a feed was carried out at a coking temperature of 500° C. Low-sulfur vacuum residue (tar) was used as a primary feedstock for production of ordinary coke (Example 1). Heavy gas oil of catalytic cracking or a mixture of heavy gas oil of catalytic cracking with furfural extract in the production of oils in a 70:30 ratio was used as a primary feedstock for production of needle coke (Examples 2 and 3). The recirculate of Examples 1-3 contained bottom residues and distillate cracking residue, but no gaseous or light boiling products formed during thermal cracking of heavy coking gas oil.

In Examples 4-6, delayed coking was carried out under the same conditions and using the same types of feeds as Examples 1-3, respectively, but using heavy coking gas oil as the recirculate only. The heavy coking gas oil used as a recirculate of Examples 4-6 included all of the gaseous and light boiling products formed during the thermal cracking of heavy coking gas oil.

Characteristics of the coking feedstocks used in Examples 1-6 are provided in Table 1. The material balance of coking and the quality of the cokes obtained in Examples 1-6 are provided in Table 2.

TABLE 1

| Primary feedstock characteristics | | | |
|---|---|---|---|
| Factor | Tar | Catalytic Cracking Heavy Gas Oil (CCHGO) | Furfural extract in the production of oils (FEPO) |
| Density, g/cm$^3$ | 0.9818 | 1.026 | 0.9434 |
| Coking ability, % wt. | 11.5 | 4.27 | 0.58 |
| Sulfur content, % wt. | 1.2 | 0.46 | 0.45 |
| Kinematic viscosity at 100° C., cSt | 222.42 | 4.84 | 3.84 |
| Content, ppm | | | |
| V | 37.2 | 6.0 | 5.0 |
| Ni | 14.7 | 3.0 | 2.0 |
| Ash content, % wt | 0.027 | | |
| Fractional composition | | | |
| Initial Boiling Point (IBP), ° C. | 388 | 305 | 395 |
| 5% vol., boils at a temperature of, ° C. | 437 | 340 | 406 |
| 10% vol., boils at a temperature of, ° C. | 462 | 349 | 410 |
| 20% vol., boils at a temperature of, ° C. | 492 | 364 | 417 |
| 30% vol., boils at a temperature of, ° C. | | 369 | 422 |
| 40% vol., boils at a temperature of, ° C. | | 376 | 426 |
| 50% vol., boils at a temperature of, ° C. | Lower | 384 | 431 |
| 60% vol., boils at a temperature of, ° C. | 500° C. | 392 | 435 |
| 70% vol., boils at a temperature of, ° C. | boils | 404 | 442 |
| 80% vol., boils at a temperature of, ° C. | 24% vol. | 425 | 447 |
| 90% vol., boils at a temperature of, ° C. | | 475 | 463 |
| 95% vol., boils at a temperature of, ° C. | | — | 475 |
| End Boiling Point (EBP), ° C. | | — | 480 |
| Overall hydrocarbon composition, % mass: | | | |
| paraffin-naphthenic hydrocarbons | 20.6 | 30.0 | 51.6 |
| aromatic hydrocarbons, | 62.2 | 65.0 | 42.7 |
| including: light | 15.2 | 1.8 | 10.3 |
| medium | 10.5 | 3.7 | 13.2 |
| heavy | 36.5 | 59.5 | 19.2 |
| resins, | 16.4 | 5.0 | 5.7 |
| including: I | 6.6 | 2.2 | 2.9 |
| II | 8.8 | 2.8 | 2.8 |
| asphaltenes | 1.8 | absent | absent |

TABLE 2

Material balance of coking and quality of cokes obtained

| | Examples 1-3 (disclosed process) | | | Examples 4-6 (comparative process) | | |
|---|---|---|---|---|---|---|
| | Primary coking feed | | | | | |
| | Tar | CCHGO | Mixture of CCHGO and (FEPO) (70:30) | Tar | CCHGO | Mixture of CCHGO and (FEPO) (70:30) |
| | Example | | | | | |
| Factors | 1 | 2 | 3 | 4 | 5 | 6 |
| Material balance, wt % | | | | | | |
| hydrocarbon gas | 15.1 | 15.4 | 15.3 | 15.4 | 15.9 | 15.7 |
| gasoline (fraction b.p. 180° C.) | 14.6 | 10.3 | 10.9 | 14.9 | 10.6 | 11.5 |
| light gas oil (fraction 180-350° C.) | 42.1 | 48.5 | 49.1 | 42.3 | 48.8 | 49.7 |
| heavy gas oil (fraction ≥ 350° C.) | — | — | — | — | — | — |
| coke | 28.2 | 25.8 | 24.7 | 27.4 | 24.7 | 23.1 |
| Recirculation factor | 1.8 | 1.8 | 1.8 | 1.8 | 1.8 | 1.8 |
| Plant feed throughput capacity, TPH (tons per hour) | 35.7 | 35.7 | 35.7 | 35.7 | 35.7 | 35.7 |
| Linear velocity of vapors in the coking chamber, m/s | 0.120 | 0.098 | 0.11 | 0.151 | 0.113 | 0.125 |
| Coking cycle (hrs) | 23 | 26 | 28 | 26 | 28 | 31 |
| Coke quality: | | | | | | |
| sulfur content, % wt. | 1.38 | 0.41 | 0.40 | 1.59 | 0.43 | 0.42 |
| content of V, ppm | 0.0150 | — | — | 0.020 | — | — |
| content of Ni, ppm | 0.006 | — | — | 0.008 | — | — |
| evaluation of coke microstructure, points | — | 5.9 | 5.6 | — | 5.7 | 5.4 |
| mechanical strength, kg/cm$^2$ | 83 | — | — | 56 | — | — |

The results of Examples 1-6 show a far superior coke yield when the process is conducted with a recirculate that does not include gaseous or light boiling products formed during thermal cracking of heavy gas oil. This was demonstrated among a variety of primary feedstocks. Coke yield from tar, which is applicable for the production of ordinary (anode) low-sulfur coke for the aluminum industry, was 28.2 wt % for the inventive process (Example 1) as compared to 27.4 wt % for the comparative process (Example 4). Needle coke yield from heavy gas oil of catalytic cracking was 25.8 wt % for the inventive process (Example 2) as compared to 24.7 wt % for the comparative process (Example 5). Needle coke yield from a mixture of heavy gas oil of catalytic cracking and furfural extract in the production of oils was 24.7 wt % for the inventive process (Example 3) as compared to 23.1 wt % for the comparative process (Example 6). Thus, the larger coke yields in Examples 1-3 as compared to the coke yields in Examples 4-6 indicate an increased production capacity of a coking plant according to the disclosed method.

As discussed above, in the disclosed process, not all products of thermal cracking of heavy coking gas oil are directed to the coking chamber, and only the heavier boiling fractions distillate cracking residue are included in the secondary feedstock. The gaseous and light boiling fractions of thermal cracking products (gas, gasoline, light gas oil) are ballast in the coking chamber and do not undergo any thermal conversions. Further, these gaseous and light boiling fractions increase the linear vapor velocities, which diminish the amount of heavy-boiling fractions in the coking chambers that could otherwise increase the yield of coke.

In addition to improvements in yield, Examples 1-6 show that the quality of the produced coke is also superior when the process is conducted with a recirculate that does not include gaseous or light boiling products formed during thermal cracking of heavy gas oil. When coking vacuum residue (tar), the contents of sulfur and organometallic compounds (e.g., V and Ni), and mechanical strength are all improved with the inventive process (Example 1) as compared to the corresponding comparative process (Example 4). For instance, the sulfur content is desirably lower—1.38 wt % (Example 1); 1.59 wt % (Example 4). The contents of V and Ni are also desirably lower—0.0150 ppm V and 0.006 ppm Ni (Example 1); 0.020 ppm V and 0.008 ppm Ni (Example 4). And the mechanical strength is considerably and desirably higher—83 kg/cm$^2$ (Example 1); 56 kg/cm$^2$ (Example 4). This is at least partly explained by the fact that a greater proportion of the coke is formed from distillate cracking residue, which itself is characterized by a lower sulfur content and an almost complete absence of organometallic compounds.

When coking heavy gas oil of catalytic cracking (Examples 2 and 5) and its mixture with a furfural extract in the production of oils (Examples 3 and 6) to produce needle coke, not only is the coke yield increased, but the structural organization of the coke is also improved. That is, the microstructure score increased in points according to GOST 26132-84, a microstructure evaluation method for petroleum and pitch cokes. See Interstate Standard, Petroleum and Pitch Cokes, Microstructure Estimation Method (Jul. 1, 1985). Specifically, the microstructure score was 5.9 points (Example 2) and 5.6 points (Example 3), compared to the lower respective values of 5.7 points (Example 5) and 5.4 points (Example 6). This result is explained at least partly by the fact that preventing the ballast light boiling fractions of the products of thermal cracking of heavy gas oil from entering the coking chambers provides a reduced linear vapor velocity, which substantially improves the hydrodynamic environment of the coking chambers and facilitates the formation of highly textured anisotropic coke.

Additionally, reducing the linear velocity of the vapors in the free section of the coking chambers when coking any feed according to the disclosed method will effectively increase the feed capacity of the coking chamber by increasing the available filling height. Thus, coking of any kinds of feed according to the disclosed method will increase the yield of coke and also improve its quality (i.e., the operational physicochemical parameters of ordinary anode coke and the structural parameters of needle coke) while simultaneously increasing the feed capacity of the delayed coking unit.

Examples 1-6 also show that a more efficient process is conducted with a recirculate that does not include gaseous or light boiling products formed during thermal cracking of heavy gas oil. Specifically, higher yields were obtained in a shorter number of hours—i.e., 23 hours (Example 1) compared to 26 hours (Example 4); 26 hours (Example 2) compared to 28 hours (Example 5); and 28 hours (Example 3) compared to 31 hours (Example 6).

All references cited and/or discussed in this specification are incorporated herein by reference in their entireties and to the same extent as if each reference was individually incorporated by reference.

What is claimed is:

1. A method for delayed coking of petroleum residues, comprising:

(a) mixing a primary feedstock and a recirculate in a vessel to form a secondary feedstock;

(b) heating the secondary feedstock in a furnace;

(c) directing the heated secondary feedstock to a coking chamber to form coke and vapor-liquid coking products;

(d) fractionating the vapor-liquid coking products in a fractionation column to produce gas, gasoline, light and heavy gas oils, and bottom residue;

(e) cooling the fraction of light gas oil;

(f) thermally cracking the fraction of heavy gas oil to produce gas, gasoline, light gas oil, and distillate cracking residue;

(g) combining a portion of the cooled light gas oil of step (e) with the gas, gasoline, light gas oil, and distillate cracking residue of step (f);

(h) evaporating the combined gas, gasoline, and light gas oil from the distillate cracking residue; and (i) routing the separated distillate cracking residue directly to the vessel as a component of the recirculate;

wherein the vessel is upstream of the fractionation column.

2. The method of claim 1, further comprising directing the fraction of bottom residue from the fractionation column to the vessel as a component of the recirculate.

3. The method of claim 1, wherein the gases and light boiling products separated from the distillate cracking residue in step (f) are directed to the fractionation column.

4. The method of claim 3, wherein the gases and light boiling products are mixed with the vapor-liquid coking products before entering the fractionation column.

5. The method of claim 1, wherein the coke is needle coke or anode coke.

6. The method of claim 1, wherein the primary feedstock comprises vacuum distillation residues (tar) of low sulfur oils, heavy gas oil of catalytic cracking, or a mixture of heavy gas oil of catalytic cracking and furfural extract in the production of oils.

7. The method of claim 6, wherein the mixture of heavy gas oil of catalytic cracking and furfural extract in the production of oils is in a ratio of about 70:30.

8. The method of claim 1, wherein the secondary feedstock is heated to a temperature of about 470° C. to about 510° C.

9. The method of claim 1, wherein the temperature in a bottom portion of the fractionation column is about 380° C. to about 390° C.

10. The method of claim 1, wherein thermal cracking of step (f) is conducted at a temperature of about 490° C. to about 530° C.

11. The method of claim 1, wherein the evaporating of step (h) is conducted at a temperature of about 400° C. to about 420° C.

12. The method of claim 1, wherein the coke is needle coke, and a recirculation ratio of the amount of secondary feedstock to the amount of primary feedstock is in the range of about 1.5:1 to about 2:1.

13. The method of claim 1, wherein the coke is anode coke, and a recirculation ratio of the amount of secondary feedstock to the amount of primary feedstock is in the range of about 1:1 to about 2:1.

14. The method of claim 1, wherein the evaporating step is conducted in an evaporator downstream of the fractionation column.

15. The method of claim 1, wherein step (f) comprises routing the fraction of heavy gas oil from the fractionation column directly to a thermal cracking furnace and then thermally cracking the fraction of heavy gas oil to produce gas, gasoline, light gas oil, and distillate cracking residue.

* * * * *